US008657514B2

(12) United States Patent
Kim

(10) Patent No.: US 8,657,514 B2
(45) Date of Patent: Feb. 25, 2014

(54) MULTIPURPOSE CASE

(76) Inventor: Joung Chul Kim, Bucheon (KR)

( * ) Notice: Subject to any disclaimer, the term of this patent is extended or adjusted under 35 U.S.C. 154(b) by 604 days.

(21) Appl. No.: 12/994,828

(22) PCT Filed: May 26, 2008

(86) PCT No.: PCT/KR2008/002917

§ 371 (c)(1),
(2), (4) Date: Nov. 26, 2010

(87) PCT Pub. No.: WO2009/145364

PCT Pub. Date: Dec. 3, 2009

(65) Prior Publication Data

US 2011/0076086 A1 Mar. 31, 2011

(51) Int. Cl.
*B43K 5/16* (2006.01)

(52) U.S. Cl.
USPC ..... 401/108; 401/107

(58) Field of Classification Search
USPC ..... 401/107, 108
See application file for complete search history.

(56) References Cited

U.S. PATENT DOCUMENTS 2,578,084 A * 12/1951 Mureau ..... 15/184
6,764,239 B2 * 7/2004 Kim ..... 401/108

FOREIGN PATENT DOCUMENTS

| | | |
|---|---|---|
| KR | 20-0175523 | 3/2000 |
| KR | 10-2001-0000225 | 1/2001 |
| KR | 20-0255134 | 12/2001 |
| KR | 10-2004-0079231 | 9/2004 |
| KR | 20-0433607 | 12/2006 |
| KR | 10-2008-0062157 | 7/2008 |

* cited by examiner

*Primary Examiner* — David Walczak
(74) *Attorney, Agent, or Firm* — Cantor Colburn LLP

(57) ABSTRACT

A multipurpose case having an inlet opening element and ejecting, retracting and protecting a core part without using a conventional cap. The case can use core parts having different sizes and usages in addition to specified core parts. The case can be produced at low cost and can easily eject or retract the core part by rotating or pulling the lower cap. The case includes an upper cap; a lower cap having an opening at an end and receiving a lower portion of the upper cap; an inlet opening element mounted to the lower cap and opening and closing the inlet part of the upper cap; a rotary actuator received in the lower cap; and a core part received in the rotary actuator so as to be ejected outside the upper cap along a spiral groove of the rotary actuator when the actuator is rotated by the lower cap.

8 Claims, 5 Drawing Sheets

MULTIPURPOSE CASE

TECHNICAL FIELD

The present invention relates, in general, to a multipurpose case adapted for use as a make-up instrument, such as a blush brush, a lip brush, etc., or for stationery, such as writing materials.

More particularly, the present invention relates to a multipurpose case, which is provided with an inlet opening element therein so as to eject, retract and protect a core part without using a conventional cap, and which can be used with a variety of core parts having different sizes and usages without being limited to a specified core part, thus increasing the utility of the cases, and which comprises a reduced number of elements, thus being producible at low cost, and which can be opened or closed by a simple motion of rotating or pulling a lower cap, thus easily ejecting or retracting the core part.

Make-up instruments, such as blush brushes, lip brushes, eye brushes, etc., are typically used by women for adorning the womanly beauty, so that the make-up instruments are recognized as living necessaries, which must be always carried by women who use make-up.

In the past, the design of make-up instruments had been changed from a simple design, in which a brush was attached to a brush holder such that the brush is exposed outside the brush holder without being protected, to a capped design, in which a brush holder is covered with a cap to contribute to the convenience of users who carry the make-up instruments and for preventing contamination of the brush.

However, the capped design is problematic in that the cap is a separate element fitted over the brush holder, so that it is not convenient to use the make-up instrument and the cap may be lost. Thus, in recent years, to solve the problem of the capped design, the cap is removed from the make-up instrument and an inlet opening element is provided in the case such that the brush can be covered with the inlet opening element and the inlet opening element also functions as a cap.

BACKGROUND ART

Examples of conventional cases for make-up instruments can be found in Korean U.M. Registration No. 0175523 registered on Jan. 7, 2000 and entitled "a cosmetic case which needs not cap", Korean Patent No. 0393302 registered on Jul. 21, 2003 and entitled "multipurpose case", and in Korean Patent No. 0494640 registered on Jun. 1, 2005 and entitled "hand-held multipurpose case with structure for reversibly extending functional tipped device". The above-mentioned three references were filed and owned by the inventor of this invention.

The cosmetic case of Korean U.M. Registration No. 0175523 is problematic in that the case has a three-stage structure comprising upper, middle and lower parts, thus increasing the number of elements and complicating the process of assembling and disassembling the case. Further, in the cosmetics case, a core cover used for ejecting or retracting the brush is shaped to be fitted over an actuating part, so that, when the core cover is actuated with an excess of pressure to eject the brush, the core cover may be removed from the actuating part.

Both the multipurpose case of Korean Patent No. 0393302 and the hand-held multipurpose case with a structure for reversibly extending the functional tipped device of Korean Patent No. 0494640, filed and owned by the inventor of the present invention, were invented to overcome the problems caused in the structure of Korean U.M. Registration No. 0175523. However, the multipurpose cases of No. 0393302 and No. 0494640 can not completely solve the problems resulting from the structure of No. 0175523.

Another problem of the conventional multipurpose cases resides in that the outer appearance thereof is limited to a cylindrical shape, so that the cases do not propose a case having another shape, such as an elliptical shape, other than from the cylindrical shape. Further, because the conventional multipurpose cases have specified circular cross-sections, the cases do not propose a case having another cross-section. Therefore, it is almost impossible to install a variety of brushes having different sizes and usages in the conventional cases such that the brushes can be smoothly ejected from or retracted into the cases.

DISCLOSURE OF INVENTION

Technical Problem

Accordingly, the present invention has been made keeping in mind the above problems occurring in the related art, and is intended to provide a multipurpose case, which is provided with an inlet opening element therein so as to automatically eject and retract a brush, thus being free from a conventional cap and being convenient for users.

Further, the present invention is intended to provide a multipurpose case, which has a two-stage structure comprising an upper cap and a lower cap but not a middle cap and in which the upper cap has a structure suitable for receiving both a core part and a rotary actuator therein, thus reducing the number of elements and being easily assembled, convenient to users and produced at low cost.

Further, the present invention serves to provide a multipurpose case, which has a compact structure and reliably ejects and retracts the brush by simply rotating or pulling the lower cap, thus realizing stable forward and backward movement of the core part and the inlet opening element and being convenient for users.

Further, the present invention serves to provide a multipurpose case, which has a structure capable of being realized in a variety of shapes, such as elliptical shapes, without being limited to a specified cylindrical shape, so that the case can be used with a variety of core parts having different sizes and usages.

Further, the present invention serves to provide a multipurpose case, which comprises a reduced number of elements and realizes a secure connection between the elements, thus not breaking easily broken even should the case be used repeatedly.

Further, the present invention serves to provide a multipurpose case, which can be easily adapted to stationery, such as writing materials, in addition to a cosmetic instrument, such as a brush.

Technical Solution

In an aspect, the present invention provides a multipurpose case, which is opened or closed by actuation of a lower cap, the case comprising: an upper cap having a receiving part; a lower cap having an opening at a forward end thereof and receiving a lower portion of the upper cap, thus forming an appearance of the multipurpose case in cooperation with the upper cap; and an interior part comprising: an inlet opening element mounted to the lower cap and opening and closing an inlet part of the upper cap; a rotary actuator received in the lower cap; and a core part received in the rotary actuator and ejected outside the upper cap along a spiral groove formed in the rotary actuator when the rotary actuator is rotated by movement of the lower cap.

Further, the rotary actuator: a rotating body movably receiving the core part therein and having the spiral groove formed in an inner circumferential surface thereof, and a rotating rod provided below the rotating body and having a spiral protrusion formed on an outer circumferential surface thereof so as to allow the inlet opening element to move along the spiral protrusion, wherein the rotating rod is mounted to the lower cap, thus being rotated in conjunction with a rotation of the lower cap.

Further, the lower cap is provided with a cap seat and the inlet opening element is securely mounted to an upper surface of the cap seat, so that the inlet opening element is moved upwards and downwards in conjunction with movement of the lower cap.

Described in detail, a spiral protrusion is formed on an inner circumferential surface of the cap seat of the lower cap and a spiral groove is formed in an outer circumferential surface of the rotary actuator so as to be moved along the spiral protrusion.

Advantageous Effects

As described above, the multipurpose case according to the present invention is advantageous in that the rotary actuator can be easily operated by simply rotating or pulling the lower cap, thus realizing stable forward and backward movements of the core part and the inlet opening element and being convenient for users.

Further, the multipurpose case of the present invention has the two-stage structure comprising the upper cap and the lower cap but not having a middle cap and in which the upper cap has a structure suitable for receiving both the core part and the rotary actuator therein, thus comprising a reduced number of elements, thereby being easily assemblable, convenient for users and producible at low cost. Further, the multipurpose case realizes the secure connection between the elements, thus not easily breaking even when the case is used repeatedly.

Further, the structure of the multipurpose case according to the present invention can be realized in a variety of shapes, such as elliptical shapes, without being limited to a specified cylindrical shape, so that the case can be used with a variety of core parts having different sizes and usages.

Further, the multipurpose case of the present invention can be easily adapted to stationery, such as writing materials, in addition to a cosmetic instrument, such as a brush.

DESCRIPTION OF THE ELEMENTS IN THE DRAWINGS

Figure 1:
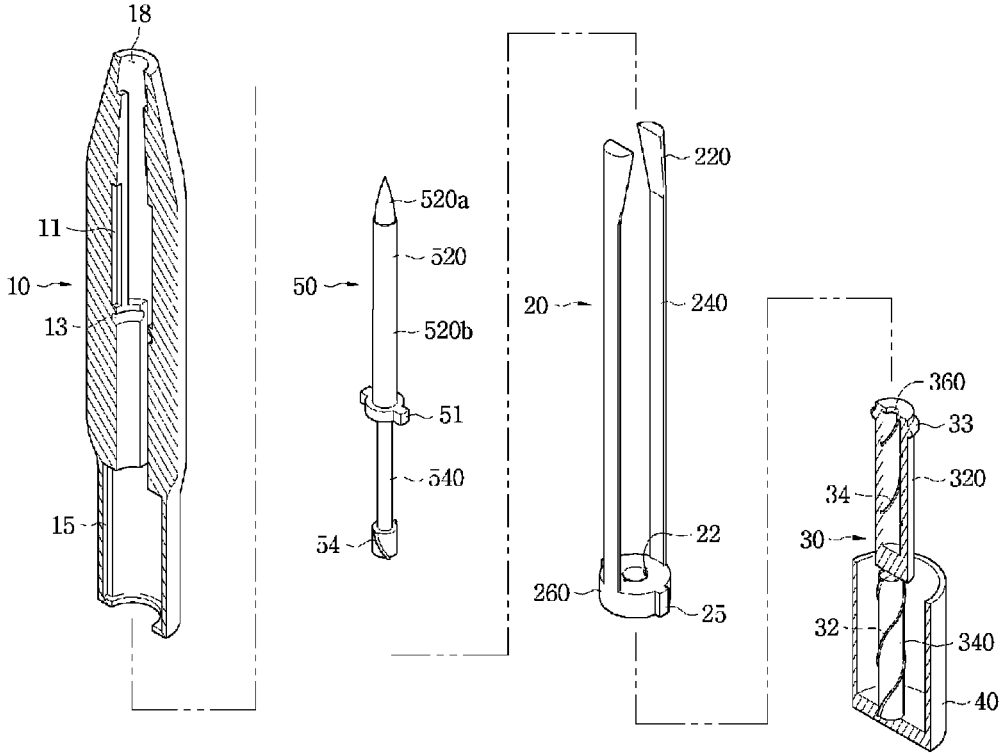
FIG. 1 is an exploded perspective view of a multipurpose case according to a first embodiment of the present invention.

10: upper cap 20: inlet opening element
30: rotary actuator 40: lower cap
50: core part 10*a*: receiving part
11: guide groove 13: annular groove
15: anti-rotation groove 220: openable head
240: slide bar 260: fitting part
22: spiral actuating groove 25: anti-rotation lug
320: rotating body 340: rotating rod
360: stop end 30*a*: stop end
33: annular protrusion 34: spiral groove
36: spiral protrusion 42: spiral groove
45: cap seat 51: guide protrusion
54: spiral protrusion

Best Mode For Carrying Out The Invention

Hereinbelow, the present invention will be described in detail with reference to the accompanying drawings.

Figure 2:
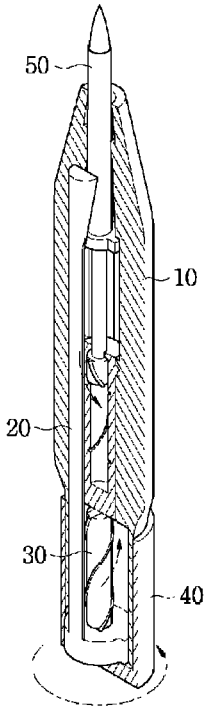
FIG. 2 is a perspective view showing an ejected state of a core part provided in the case according to the present invention.
Figure 3:
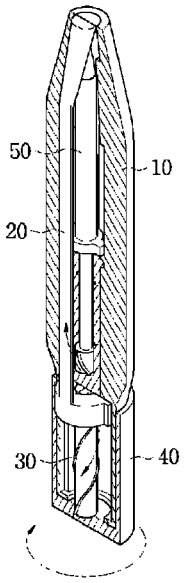
FIG. 3 is a perspective view showing a retracted state of the core part provided in the case according to the present invention.

For ease of description, the direction of the multipurpose case according to the present invention is specified based on the direction in FIGS. 2 and 3, in which the end of the case having the core part 50 will be referred to as the forward or upward end of the case and the opposite end will be referred to as the rearward or downward end. Further, FIGS. 6 through 10 show a multipurpose case according to a second embodiment of the present invention, in which the elements common with those of the first embodiment shown in FIGS. 1 through 5 in their constructions and operations will be designated by the same technical terms and reference numerals as those of the elements in the first embodiment.

Figure 9:
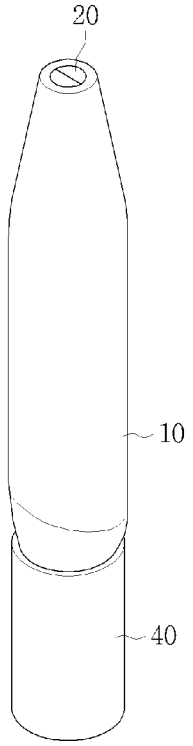
FIG. 9 is a perspective view showing the appearance of an upper cap, which forms part of a multipurpose case according to another embodiment of the present invention.
Figure 10:
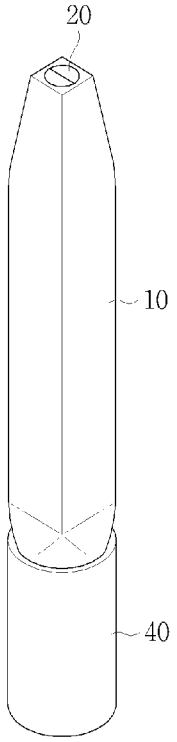
FIG. 10 is a perspective view showing the appearance of an upper cap, which forms part of a multipurpose case according to a further embodiment of the present invention.

As shown in the drawings, the outer case of the multipurpose case according to the present invention has a two-stage structure instead of a conventional complex structure. Further, as shown in FIG. 10, the appearance of the case is not limited to a specified cylindrical shape, but may be freely designed. For example, the lower cap may be configured to form a cylindrical shape and the upper cap may be configured to form a rectangular cross-section. Alternatively, the appearance of the case may be designed to form a variety of shapes, such as an elliptical shape as shown in FIG. 9 or a shape having a triangular cross-section. Due to the shape of the case according to the present invention, a user can easily hold the case with the fingers while using the case. Further, even when the fingers of a user unexpectedly drop the case to the floor while using it, the case does not easily roll on the floor due to the angled shape thereof, so that the case is convenient for users.

Further, the above-mentioned construction of the multipurpose case according to the present invention can be realized by the two-stage structure of the outer case comprising the upper cap and the lower cap. The two-stage structure of the outer case also reduces the number of elements of the multipurpose case, thus reducing the production cost of the case.

Further, because the present invention can provide a variety of cases having different shapes, the multipurpose case of the present invention can be used with a variety of core parts having different usages. This advantage will be described in detail with reference to FIG. 1 using a make-up brush as the core part.

Generally, the make-up brushes have different shapes according to their usages. The shapes of the make-up brushes are determined according to the parts of the human body which the brushes come into contact with. Examples of the conventional make-up brushes are a blush brush, which has a lot of bristles 520*a* and a thick bristle holder 520*b*, an eye brush, in which the bristle holder 520*b* is thinner than that of the blush brushes and has a deformed elliptical cross-section instead of a circular cross-section, and a lip brush, which has a reduced number of bristles 520*a* and a thinner bristle holder 520*b*. Particularly, because the blush brushes and the eye brushes have a lot of bristles and the cross-section of their bristle holders are not limited to a circular cross-section, it is very difficult to use the conventional cases as the case of a blush brush or an eye brush. However, in the multipurpose case of the present invention, the cross-section of the upper cap 10, which receives the core part 50 therein, is not limited to a circular section, but may be freely designed as a rectangular section, an elliptical section, etc., according to the usages of the core parts, so that the space for installing the core parts therein can be enlarged. Thus, the case of the present invention can be used with a variety of core parts and solves the problems of conventional cases.

Hereinbelow, the interior structure of the multipurpose case according to the present invention will be described in detail with reference to FIG. 1.

The case of the present invention comprises an upper cap 10, an inlet opening element 20, a rotary actuator 30, a lower cap 40, and a core part 50.

The lower cap 40 is open in the front end thereof so as to be partially engaged with the upper cap 10, while the upper cap 10 is open in the rear end thereof so as to engage with the lower cap 40. Further, the front end of the upper cap 10 is open so as to eject or retract the core part 50 and has a receiving part 10*a* therein. The upper cap 10 may be configured such that the inner and outer diameters of the front end thereof are gradually reduced to form a frusto-conical inlet part 18 for passing the core part 50 therethrough. In other words, even though the upper cap 10 and the lower cap 40 are typically designed to have tubular shapes, the cross-section of the tubular upper cap 10 may be freely designed to form a variety of shapes in cross-section, such as a rectangular or an elliptical cross-section, according to the usage of the core part 50 and without being limited to a circular cross-section.

In other words, the inner structure of the upper cap 10 in the present invention is formed to receive both the core part 50 and the rotary actuator 30 therein, so that the multipurpose case of the present invention is different from the conventional multipurpose case, which needs a separate part for receiving both the core part 50 and the rotary actuator 30 therein.

Due to the above-mentioned construction, the number of parts constituting the multipurpose case of the present invention is reduced to five, so that, unlike the conventional cases having complex constructions and many parts, the case of the present invention can be produced through a simple process at low cost and can be easily and simply assembled.

Further, the rotary actuator 30 of the present invention comprises a rotating body 320, which is provided with a spiral groove 34 on an inner circumferential surface thereof and receives the core part 50 therein such that the core part 50 can be moved vertically upwards and downwards, and a rotating rod 340, which is connected to the rotating body 320 and is provided with a spiral protrusion 32 on an outer circumferential surface thereof. The rotating rod 340 is securely mounted to the lower cap 40 and is rotatable along with the lower cap 40.

Further, the rotating body 320 of the rotary actuator 30 is provided with an annular protrusion 33 around the outer circumferential surface thereof such that the annular protrusion 33 can engage with an annular groove 13 formed in the inner circumferential surface of the upper cap 10. Thus, when the lower cap 40 is rotated, only the rotary actuator 30 can be idle-rotated in the state where the upper cap 10 is fixed. In the present invention, the construction of the rotary actuator 30 may be altered such that an annular groove is formed in the outer circumferential surface of the rotating body 320 and an annular protrusion is formed on the inner circumferential surface of the upper cap 10, and the annular protrusion is engaged with the annular groove. However, for ease of engagement, it is desired to form the annular protrusion 33 on the outer circumferential surface of the rotating body 320 and form the annular groove 13 in the inner circumferential surface of the upper cap 10.

When the core part 50 comprises a core 520 and a push rod 540 and the case of the present invention is used as a case for make-up brushes, the core 520 may comprise bristles 520*a*, which come into contact with the skin of a user, and a bristle holder 520*b*. Further, when the case of the present invention is used as a case for writing materials, a ball-point pen core or a pencil core may be used instead of the bristles 520*a*.

In the core part 50, a spiral protrusion 54 is formed around the outer circumferential surface of a lower part below the push rod 540. A spiral groove 34 is formed in the inner circumferential surface of the rotating body 320 of the rotary actuator 30 so as to be engaged with the spiral protrusion 54. Thus, when the lower cap 40 is rotated in one direction, the rotary actuator 30 is rotated in the same direction. In the above state, the spiral protrusion 54 moves the core part 50 in one direction while being moved along the spiral groove 34.

Even when the rotary actuator 30 of the present invention is rotated, the core part 50 connected to the rotary actuator 30 can rectilinearly move upwards and downwards.

To realize the above-mentioned operation, a guide groove 11 is formed in the inner circumferential surface of the upper cap 10 so as to define a moving passage for the core part 50. Further, the core part 50, particularly, the outer circumferential surface of a part above the push rod 540 is provided with a guide protrusion 51. Thus, the rotation of the rotary actuator can be converted into rectilinear movement of the core part.

Described in detail, the spiral protrusion 54, which is formed in the lower part of the push rod 540 of the core part 50, is moved in the rotating body 320 while being guided by a spiral groove 34 formed in the inner circumferential surface of the rotating body 320 of the rotary actuator 30. In the above state, due to the rectilinear guide groove 11 of the upper cap, the rotary actuator 30 is rotated. Here, the spiral protrusion 54 of the core part 50 is moved along the spiral groove 34 of the rotary actuator 320 and the guide protrusion 51 is moved along the guide groove 11 of the upper cap 10, so that the core part 50 can be moved upwards and downwards in vertical directions.

In the present invention, a stop end 360 is formed in the uppermost end of the rotary actuator 30, so that, when the core part 50 is ejected outside the inlet part 18, the spiral protrusion 54 of the core part 50 can be stopped by the stop end 360 while being moved in the rotating body 320 of the rotary actuator 30. Thus, the core part 50 can be prevented from being unexpectedly removed from the rotating body 320.

Further, it is preferred to form a groove-shaped shelter (not shown) in the upper end of the spiral groove 34 of the rotary actuator 30 such that the spiral protrusion 54 of the core part 50 can be remained in the shelter and the core part 50, which is exposed outside the inlet part 18 of the upper cap 10, can be retracted into the upper cap 10 when the core part 50 is overloaded by pressure exceeding a predetermined level.

Further, it is preferred to form the guide protrusion 51 and the spiral protrusion 54 of the core part 50 such that they are oriented in diverged directions rather than in the same direction, so that the core part 50 can be easily assembled with both the rotary actuator and the upper cap and the spiral protrusion 54 can be stopped by the stop end 360 and can be prevented from being removed from the rotary actuator 30.

Hereinbelow, the inlet opening element 20 functioning as the cap of a conventional case will be described.

The inlet opening element 20 of the present invention comprises an openable head 220, which has a size and an inner diameter corresponding to those of the inlet part 18 of the upper cap 10, a slide bar 240 extending from the openable head 220, and a fitting part 260 mounted to the lower end of the slide bar 240.

In the inner circumferential surface of the fitting part 260, a spiral actuating groove 22 is formed so as to be movably engaged with the spiral protrusion 32 of the rotary actuator 30.

Thus, the fitting part 260 can be moved vertically upwards and downwards along the rotating rod 340.

Here, the fitting part 260 may be rotated by rotating the rotating rod 340. Thus, separate means, functioning to realize upward and downward movement of the fitting part 260 in vertical directions while preventing rotation of the fitting part 260, must be provided in the case of the present invention.

The fitting part 260 is provided with an anti-rotation lug 25 on the outer circumferential surface thereof, and the upper cap 10 is provided with a rectilinear anti-rotation groove 15 in the inner circumferential surface thereof so as to be engaged with the anti-rotation lug 25.

Thus, even when the rotating rod 340 is rotated, the anti-rotation lug 25 executes rectilinear movement while being guided by the anti-rotation groove 15 and makes the fitting part 260 of the inlet opening element 20 move upwards and downwards in vertical directions.

Further, to make the openable head 220 open the inlet part 18 of the upper cap 10 more efficiently, it is preferred to configure the upper cap 10 such that the inner and outer diameters of the cap 10 are gradually reduced in a forward direction to form the inlet part 18 having a frusto-conical shape.

When the lower cap 40 and the rotary actuator 30 are rotated in a state in which the inlet part 18 is remaining in a closed state by the openable head 220, the anti-rotation lug 25 of the inlet opening element 20 is smoothly moved downwards along the anti-rotation groove 15 formed in the inner circumferential surface of the upper cap 10, so that the inlet part 18 is opened.

In the above description, the multipurpose case of the present invention has been described with a make-up brush used as the core part 50. However, the multipurpose case of the present invention may be adapted to a case for writing materials. When the case is used as a case for writing materials, it is preferred to provide a spring in the outer circumferential surface of the core part 50 so as to stably maintain the core part 50 in an ejected state.

In other words, when the case is used as a case for writing materials, a user may apply a higher pressure to the case or to the core part than that applied to a case for make-up brushes. Thus, the case may fail to provide writing materials for the long term. However, the present invention can solve the problem by providing a spring, which is wound twice around the outer circumferential surface of the core part 50, more preferably, around the outer circumferential surface of the push rod 540 at a location above the spiral protrusion 54. Thus, when the spiral protrusion 54 of the core part 50 is caught in the shelter (not shown) and the core part 50 is maintained in an ejected state, the core part 50 can be more stably maintained in the ejected state by elasticity of the spring, which is located between the upper surface of the spiral protrusion 54 and the lower surface of the stop end 360 of the rotary actuator 30.

Hereinbelow, the operation of the multipurpose case according to the present invention having the above-mentioned construction will be described with reference to FIG. 2 and FIG. 3.

FIG. 2 shows the core part 50 maintained in an ejected state. When the lower cap 40 in the above state is rotated in one direction, the rotary actuator 30, which is operated in conjunction with the lower cap 40, is idle-rotated in a state in which the actuator 30 is engaged with the annular groove 13 of the upper cap 10. Thus, the spiral protrusion 54 of the core part 50, which is received in the rotating body 320 of the rotary actuator 30, is moved along the spiral groove 34 and, at the same time, the guide protrusion 51 of the core part 50 is rectilinearly moved upwards along the guide groove 11 of the upper cap 10, so that the core part 50 is ejected outside the upper cap 10 through the inlet part 18.

When the core part 50 is moved upwards to be ejected, the inlet opening element 20 is moved downwards in the direction opposite to the moving direction of the core part 50. Described in detail, the spiral actuating groove 22, which is formed in the inner circumferential surface of the fitting part 260 of the inlet opening element 20, is moved downwards along the spiral protrusion 32 of the rotary actuator 30 and the openable head 220 is also moved downwards, thus opening the inlet part 18 of the upper cap 10 and the core part 50 is ejected outside the upper cap 10.

As described above, the inlet opening element 20 in the above state is rectilinearly moved downwards by the movable engagement of the anti-rotation lug 25 and the anti-rotation groove 15.

When the lower cap 40 is rotated in the opposite direction, the core part 50 is moved downwards as shown in FIG. 3, and the fitting part 260 is moved upwards along the spiral protrusion 32, so that the inlet opening element 20 closes the inlet part 18 of the upper cap 10.

To realize the above-mentioned operation, even when the outer cross-section of the upper cap 10 of the multipurpose case is designed to have a variety of shapes other than the circular one so as to be able to be used with a variety of core parts and to make the multipurpose case be highly convenient to users, the rotating parts in the multipurpose case must be designed to have circular cross-sections.

Examples of the rotating parts required to have circular cross-sections in the multipurpose case are a part of the upper cap 10, which receives the rotary actuator 30 therein, the rotary actuator 30, and the central hole of the fitting part 260 of the inlet opening element 20, which corresponds to the rotating rod 540.

The other parts in the multipurpose case may be freely configured to have a variety of cross-sectional shapes such that the case can be used with different core parts having a variety of sizes and shapes, has a good appearance and is convenient to users.

Hereinbelow, the second embodiment of the present invention will be described with reference to FIGS. 4 through 8. Unlike the multipurpose case according to the first embodiment of the present invention, the multipurpose case according to the second embodiment is configured such that the rotary actuator can be rotated by pulling the lower cap, thus ejecting the core part.

Figure 4:
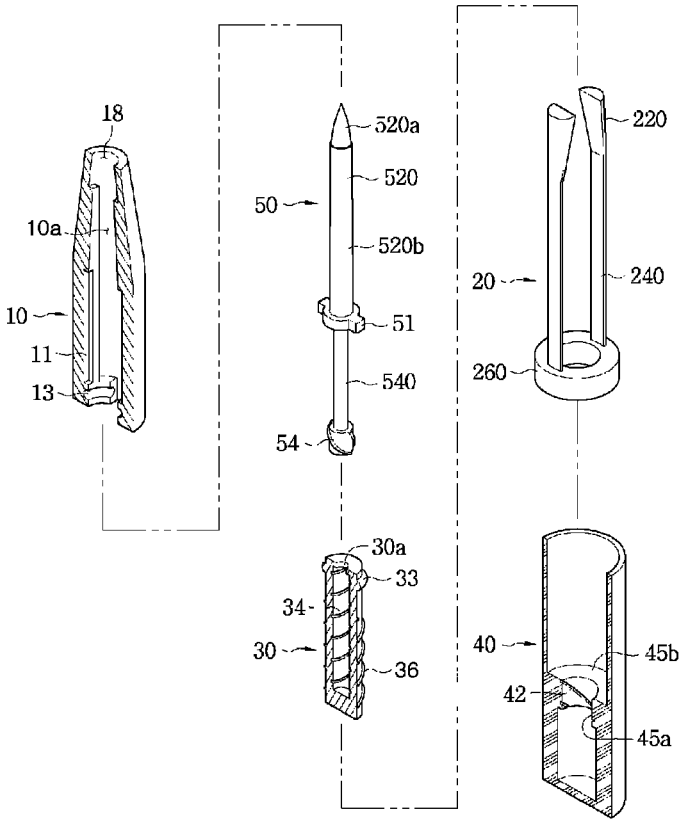
FIG. 4 is an exploded perspective view of a multipurpose case according to a second embodiment of the present invention.

As shown in FIG. 4, the multipurpose case according to the second embodiment comprises an upper cap 10; a lower cap 40, which is assembled with the upper cap 10 in a state in which the lower cap 40 overlaps and covers a lower part of the upper cap 10, and is provided with a cap seat 45 for seating the upper cap 10 thereon; a rotary actuator 30, which is provided with a spiral protrusion 36 so as to move forwards while being rotated along a spiral groove 42 formed in the inner circumferential surface 45*a* of the cap seat 45 of the lower cap 40 when the lower cap 40 is pulled downwards; a core part 50, which is received in the receiving part 15 of the upper cap 10 and is ejected outside the case in response to a rotation of the rotary actuator 30; and an inlet opening element 20, which comprises an openable head 220, a slide bar 240 extending from the openable head 220, and a fitting part 260 mounting the slide bar 240 to the cap seat 45 of the lower cap 40, thus moving upwards and downwards in conjunction with downward movement of the lower cap 40.

The rotary actuator 30 is constructed as follows.

A spiral groove 34 is formed in the inner circumferential surface of the rotary actuator 30, so that a spiral protrusion 54 of the core part 50, which will be described in detail later herein, can be moved upwards and downwards along the spiral groove 34.

A spiral protrusion 36 is formed on the outer circumferential surface of the rotary actuator 30, so that the lower cap 40 can be moved upwards and downwards by the movable engagement of the spiral protrusion 36 and the spiral groove 42 formed in the inner circumferential surface 45*a* of the cap seat 45 of the lower cap 40. To realize a smooth rotation of the rotary actuator 30, it is preferred to form the spiral groove 42 only on an upper portion of the inner circumferential surface 45*a* of the cap seat 45 of the lower cap 40 rather than on the entire surface of the inner circumferential surface 45*a*.

In other words, when the lower cap 40 according to the second embodiment is pulled downwards with one hand while holding the upper cap 10 with the other hand, the spiral protrusion 36 of the rotary actuator 30 is moved along the spiral groove 42 formed in the inner circumferential surface 45*a* of the cap seat 45 of the lower cap 40. Due to the movement of the spiral protrusion 36, the core part 50 received in the rotary actuator 30 can be ejected outside the upper cap 10.

Thus, when the spiral groove 42 of the lower cap 40 is aligned with an upper portion of the spiral protrusion 36 of the rotary actuator 30, the length of the multipurpose case of the present invention becomes shortest.

However, when the rotary actuator 30 is rotated upwards by the upward movement of the spiral protrusion 36 along the spiral groove 42 so as to eject the core part 50 outside the upper cap 10, the length of the case becomes the longest.

Thus, the present invention having the above-mentioned construction does not need an additional screw-type rotating member unlike the conventional multipurpose cases, so that the present invention can realize another advantage of, when the core part is in a fully retracted state, the entire length of the multipurpose case being able to be reduced by the length of the conventional screw-type rotating member.

Figure 7:
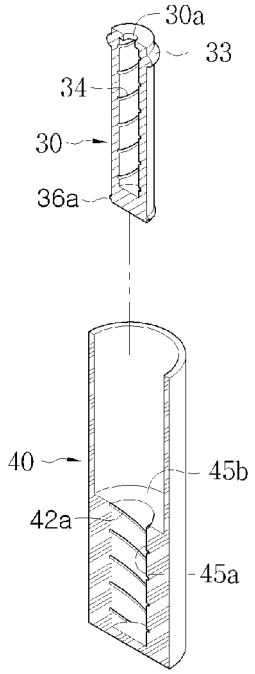
FIG. 7 and FIG. 8 are exploded perspective views showing different substitutions both of a rotary actuator and of a lower cap, which forms part of the multipurpose case according to the second embodiment of the present invention.
Figure 8:
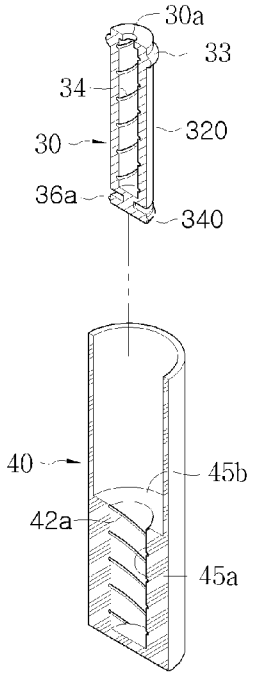

In the present invention, the construction of the rotary actuator 30 and the lower cap 40 receiving the actuator 30 therein may be altered as shown in FIG. 7. That is, as shown in FIG. 7, a rotating protrusion 36*a* is formed around a lower portion of the outer circumferential surface of the rotary actuator 30, while a spiral groove 42*a* is formed in the inner circumferential surface 45*a* of the cap seat 45 of the lower cap 40 so as to correspond to the rotating protrusion 36*a*. Thus, when the lower cap 40 is pulled downwards, the rotary actuator 30 can be rotated upwards. To realize smooth rotation of the rotary actuator 30, one rotating protrusion 36*a* is preferably formed around the lower end of the outer circumferential surface of the rotary actuator 30.

Further, as shown in FIG. 10, a rotating disc 340 may be formed in the rotary actuator 30 such that the rotating disc 340 is spaced apart from the rotating body 320, while a rotating protrusion 36*a* may be formed around the outer circumferential surface of the rotating disc 340, thus realizing upward and downward rotational movement of the rotary actuator 30.

Hereinbelow, the inlet opening element 20 will be described.

The inlet opening element 20 comprises an openable head 220, which has a cross-section corresponding to the inner diameter of the inlet part 18 of the upper cap 10, a slide bar 240 extending to the openable head 220, and a fitting part 260 mounted to the lower end of the slide bar 240.

The fitting part 260 is securely mounted to an upper surface 45*b* of the cap seat 45 of the lower cap 40, so that, when the lower cap 40 is pulled downwards, the inlet opening element 20 can be moved downwards so as to open the inlet part 18 of the upper cap 10.

Further, to make the openable head 220 open the inlet part 18 of the upper cap 10 more efficiently, it is preferred that the upper cap 10 be configured such that the inner and outer diameters of the cap 10 gradually reduce in a forward direction to form the inlet part 18 having a frusto-conical shape.

Hereinbelow, the operation of the multipurpose case according to the embodiment of the present invention will be described with reference to FIG. 5 and FIG. 6.

Figure 5:
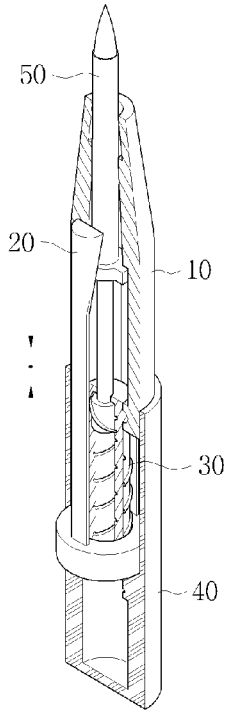
FIG. 5 is a perspective view showing an ejected state of a core part provided in the case according to the second embodiment of the present invention.

FIG. 5 shows an ejected state of the core part 50.

When the lower cap 40 is pulled downwards with one hand while holding the upper cap 10 with the other hand, the inlet opening element 20 integrated with the lower cap 40 is moved downwards, so that the openable head 220 of the inlet opening element is pulled downwards, thus opening the inlet part 18 of the upper cap 10.

When the lower cap 40 is moved downwards, the spiral protrusion 36 of the rotary actuator 30 received in the lower cap is moved upwards along the spiral groove 42, which is formed in the inner circumferential surface 45*a* of the cap seat of the lower cap. Further, the spiral protrusion 54 of the core part 50 received in the rotary actuator 30 is moved upwards along the spiral groove 34 of the rotary actuator 30, thus ejecting the core part 50 outside the upper cap 10. In the above state, the core part 50 is caught in the shelter (not shown), which is formed in the upper end of the spiral groove 34 of the rotary actuator, thus preventing unexpected retraction of the core part 50 into the upper cap 10 before pressure higher than a predetermined level is applied to the core part 50.

Figure 6:
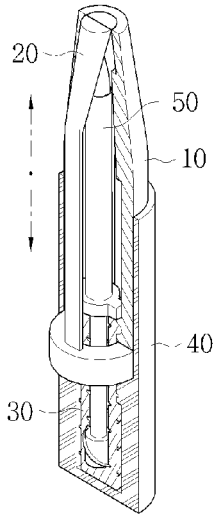
FIG. 6 is a perspective view showing a retracted state of the core part provided in the case according to the second embodiment of the present invention.

On the contrary, as shown in FIG. 6, when the lower cap 40 is pushed upwards in the state in which the upper cap 10 is fixed, the inlet opening element 20 mounted to the lower cap 40 is moved upwards, so that the openable head 220 of the inlet opening element closes the inlet part 18.

When the lower cap 40 is pushed upwards as described above, the rotary actuator 30, which has been placed on the upper surface 45*b* of the cap seat 45 of the lower cap 40, is moved downwards by the downward movement of the spiral protrusion 36 of the rotary actuator 30 along the spiral groove 42 formed in the inner circumferential surface 45*a* of the cap seat 45. Further, the spiral protrusion 54 of the core part 50 connected to the rotary actuator 30 is moved downwards along the spiral groove 34 of the rotary actuator 30. Thus, as shown in FIG. 3, the core part 50 and the rotary actuator 30 are received in the lower cap 40, so that the multipurpose case can realize the shortest possible length.

The invention claimed is:

1. A multipurpose case, which is opened or closed by actuation of a lower cap, the case comprising:

an upper cap having a receiving part;

a lower cap having an opening at a forward end thereof and receiving a lower portion of the upper cap, thus forming an appearance of the multipurpose case in cooperation with the upper cap; and an interior part comprising:

an inlet opening element mounted to the lower cap and opening and closing an inlet part of the upper cap;

a rotary actuator received in the lower cap; and a core part received in the rotary actuator and ejected outside the upper cap along a spiral groove formed in the rotary actuator when the rotary actuator is rotated by movement of the lower cap, wherein the rotary actuator comprises:

a rotating body movably receiving the core part therein and having the spiral groove formed in an inner circumferential surface thereof, and a rotating rod provided below the rotating body and having a spiral protrusion formed on an outer circumferential surface thereof so as to allow the inlet opening element to move along the spiral protrusion, wherein the rotating rod is mounted to the lower cap, thus being rotated in conjunction with a rotation of the lower cap.

2. The multipurpose case according to claim 1, wherein an annular groove is formed in an inner circumferential surface of the upper cap so as to correspond to an annular protrusion formed on an upper portion of an outer circumferential surface of the rotary actuator, wherein the rotary actuator is idle-rotated in a state in which the upper cap is fixed.

3. The multipurpose case according to claim 1, wherein a guide groove is formed in an inner circumferential surface of the receiving part of the upper cap, thus forming a moving passage for the core part, and a guide protrusion is formed on an outer circumferential surface of the core part so as to move along the guide groove, wherein a rotation of the rotary actuator is converted into rectilinear movement of the core part.

4. The multipurpose case according to claim 1, wherein a spiral protrusion is formed on a lower portion of an outer circumferential surface of the core part so as to move upwards and downwards along the spiral groove of the rotary actuator.

5. The multipurpose case according to claim 1, wherein the inlet opening element comprises:

an openable head having a cross-section corresponding to an inner diameter of the inlet part of the upper cap;

a slide bar connected to the openable head; and a fitting part mounted to a lower end of the slide bar, wherein a spiral actuating groove is formed in an inner circumferential surface of the fitting part so as to realize upward and downward movement of the inlet opening element.

6. The multipurpose case according to claim 5, wherein an anti-rotation lug is formed on an outer circumferential surface of the fitting part and a linear anti-rotation groove is formed in an inner circumferential surface of the upper cap so as to receive the anti-rotation lug therein, wherein, when the lower cap is rotated, the anti-rotation lug is moved along the anti-rotation groove, thus realizing rectilinear upward and downward movement of the inlet opening element.

7. The multipurpose case according to claim 1, wherein the lower cap is provided with a cap seat and the inlet opening element is securely mounted to an upper surface of the cap seat, so that the inlet opening element is moved upwards and downwards in conjunction with movement of the lower cap.

8. The multipurpose case according to claim 7, wherein a spiral groove is formed on an inner circumferential surface of the cap seat of the lower cap and a spiral protrusion is formed in an outer circumferential surface of the rotary actuator so as to be moved along the spiral protrusion.

* * * * *